United States Patent [19]

Stefan et al.

[11] 4,284,436

[45] Aug. 18, 1981

[54] PROCESS FOR THE PRODUCTION OF BANDS OR SHEETS OF ISOTROPIC MECHANICAL PROPERTIES FROM COPPER OR COPPER ALLOYS

[76] Inventors: Mihaly Stefan, 6, Mak u., Budapest 1022; Lajos Almashegyi, 6, Regiposta u., Budapest 1052; Csaba Horvath, 73a, Nemetvölgvi u., Budapest 1124; Agnes Madarasz nee Helesfai, 9, Venusz u., Budapest 1214; Peter Arato, 1, Zrinyi u., Budapest 1051; Jozsef Geiger, 119a, Hollandi u., Budapest 1213, all of Hungary

[21] Appl. No.: 3,758

[22] Filed: Jan. 15, 1979

Related U.S. Application Data

[63] Continuation-in-part of Ser. No. 735,049, Oct. 22, 1976, abandoned.

[30] Foreign Application Priority Data

Oct. 24, 1975 [HU] Hungary ..... CE 1060

[51] Int. Cl.[3] ..... C22B 15/14

[52] U.S. Cl. ..... 148/2; 75/76; 75/93 R; 75/153; 75/163; 164/473; 164/477

[58] Field of Search ..... 75/76, 153, 154, 156, 75/156.5, 93 R, 163; 148/2, 11.5 C; 164/55–59, 82, 76

[56] References Cited

U.S. PATENT DOCUMENTS

| | | | |
|---|---|---|---|
| 1,614,878 | 1/1927 | Cochrane | 75/156.5 |
| 3,097,093 | 7/1963 | Fox | 75/156.5 |
| 3,194,656 | 7/1965 | Vordahl | 75/153 |
| 3,208,846 | 9/1965 | Brumer | 75/153 |
| 3,282,680 | 11/1966 | Dare | 75/76 |
| 3,298,070 | 1/1967 | Yurko et al. | 75/76 |
| 3,824,135 | 7/1974 | Pryor et al. | 75/153 |

FOREIGN PATENT DOCUMENTS

| | | | |
|---|---|---|---|
| 847490 | 4/1977 | Belgium . | |
| 2243731 | 3/1974 | Fed. Rep. of Germany | 75/153 |
| 40-28326 | 12/1965 | Japan | 75/153 |
| 50-121121 | 2/1974 | Japan | 75/153 |
| 490854 | 2/1976 | U.S.S.R. | 75/156 |

OTHER PUBLICATIONS

Deuvent Abstract of Belgium Patent No. 847,490 of 4/21/77.

*Primary Examiner*—Michael L. Lewis

[57] ABSTRACT

The invention relates to a process for the production of bands or sheets of isotropic mechanical properties from copper and copper alloys, such bands or sheets being subjectable to intensive cold shaping. According to the invention the $ZrB_2$ (zirconium boride) content of the melted metal bath is adjusted by the addition of zirconium boride to a level between 0.01% by weight and 0.075% by weight, and if desired, not more than 50% by weight of the zirconium content of the added $ZrB_2$ is replaced by one or more of the metals Ti, V, Nv, Ca, Mg and Co, then, if desired, zirconium is added to the metal bath in a stoichiometric ratio calculated for the lead content of the alloy exceeding 0.015% by weight, then the metal bath containing the additives is solidified in the form of a band, and if desired, an inert gas atmosphere is maintained in the heat stabilizing furnace of the casting equipment and/or an inert gas lock and secondary cooling are applied during the solidification of the metal bath. By the process according to the invention, bands and sheets of controlled crystal structure and improved quality, increased malleability and suitable for an intensive (70 to 99%) cold rolling can be produced both from pure copper and from copper-bearing substances recycled to the processing plant with a content of contaminations detrimental to the plant.

2 Claims, No Drawings

PROCESS FOR THE PRODUCTION OF BANDS OR SHEETS OF ISOTROPIC MECHANICAL PROPERTIES FROM COPPER OR COPPER ALLOYS

This application is a continuation-in-part of application Ser. No. 735,049, filed Oct. 22, 1976 now abandoned.

The invention relates to a process for the production of bands or sheets of isotropic mechanical properties, such bands or sheets being subjectable to an intensive (70 to 99%) cold shaping from copper to copper alloys.

It is known from the practice of plants producing intermediate products from non-ferrous metals that nowadays two methods are applied for the production of bands and sheets from copper and copper alloys; such methods differ from each other mainly in the casting procedures applied after the melting. In the case of the earlier method already in widespread use even now, an ingot corresponding to the shape of the rolling equipments is cast from the melted metal or metal alloy into a chill mold or it is produced by a continuously or semi-continuously operated procedure. The ingots obtained in this way are then compressed or rolled hot or cold. During cold rolling, depending on the plasticity of the material or to the mechanical properties which are to be attained, heat treatment and pickling operations are applied several times. The number of these treatments depends mainly on the malleability of the metal alloy. (R. Adamec and R. Leder: Metall, 1972, Heft 4, pp. 328–332).

In the case of another, more up-to-date process, a band of at least 10 mm thickness and not more than 500–600 mm width is cast by means of a chill graphite mold, and this band is shaped to the desired dimensions by repeated cold rolling, heat treatment and pickling. Depending on the malleability of the cast material, also a homogenizing heat treatment is often applied prior to shaping (H. Gooszens and E. Nosch: Zeitschrift fur Metallkunde 64, 79–84 [1973]). Advantages of this technology are: more favorable yields, simpler ways of shaping and a higher weight of rolls. However, the production of bands and sheets by this method from copper, beryllium bronze and aluminum bronze of excellent electric conductivity is at present still unknown.

Significant difficulties are encountered with both processes by the columnar or radial crystal structure of unfavorable dimensions and direction, further by the various, often occurring contaminating elements deteriorating the malleability of the material, causing cracks both at hot rolling and at cold rolling, thus reducing the yield and deteriorating the properties to be attained. As a further complication, the materials recycled from the operational process to the melting operation are often mixed up with each other and thus they become contaminated in a detrimental way.

In order to reduce the detrimental effect of certain elements entering copper and copper alloys in low concentrations, adequate alloying components e.g. for decreasing the oxygen content of copper phosphorus, lithium or magnesium are often added to the melt. A great drawback of this method, however, is that the alloying elements are to be applied in a great excess, and that the residual deoxidizing element has a detrimental effect on one of the most important properties of copper: on its electric conductivity.

Oxygen-free copper of high conductivity is often produced by melting under vacuum or in a protective atmosphere containing carbon monoxide. However, the horizontal continuous casting of bands from molten copper is today a still unsolved problem.

For a long time there has been a tendency in the technical practice, particularly in the manufacture of bands used for deep-drawing purposes, to decrease the so-called texture formation which detrimetally affects the deep-drawing properties or any further shaping of the product. This texture formation occurs in copper and in copper alloys upon a cold rolling over 70% and at a tempering heat treatment carried out at a temperature over 400° C. It has been found that this detrimental anisotropy or texture appears in copper only in the composition range of 0.01 to 0.05% P, and of 0.1 to 0.5% Be, and at Cd contents exceeding 0.1%, and does not appear at Be and P contents over these values (j. Vero: Altalanos Metallografia, Vol. II: Femek es otvozetek tulajdonsagai [General Metallography, Vol. II: Properties of Metals and Alloys], Akademiai Kiado, Budapest, 1956, p. 360 [in Hungarian]). The presence of such an amount of alloying elements, however, makes copper unsuitable for use as an electric conductor.

Isotropic properties can be secured also by cold rolling at lower (50 to 60%) reduction rates and by more frequent tempering. This treatment, in turn, reduces to a great extent the efficiency of the rolling mill and appreciably increases the costs of the process.

The detrimental effect of certain contaminating elements, such as Bi, Pb, S, O, Fe+P, As and Sb, on the hot malleability of pure copper and of copper alloys having an $\alpha$-tissue structure, such as copper-nickel, nickel silver, brass, tin and aluminum bronzes is known from the literature and from general industrial practice. The detrimental effect of contamination by lead which occurs the most frequently is mostly known. The tolerable maximum Pb content is 0.02% in $\alpha$-brass, 0.015% in nickel silver, and 0.004% in tin bronze. Lead contents over these limit values may cause upon hot shaping and in horizontal band casting, various fractures and cracks, whereas upon cold rolling extended marginal cracks. Thus, the products are unsuitable for any further processing or can be worked up only at the cost of appreciable losses in material and product quality.

In order to eliminate the detrimental effect of Pb and Bi on the hot malleability of copper and copper alloys, elements which form metal compounds of high melting point with lead and bismuth are alloyed to the basic metal. The hot malleability of contaminated copper is thus improved by the addition of Ca, Ce or Zr, whereas that of brasses is improved by the addition of Ce, Zr, Li or U and that of the alloy of copper, nickel and zinc (called "copper silver" in the Anglo-Saxon literature) by the addition of Ce (Maltsev et al: Metallografiya tsvetnykh metallov i splavov. Metallurgizdat, Moskva, 1960, p. 19 [in Russian]).

All these methods of improving hot malleability are, however, unsuitable for the refining of crystal grains or for the elimination of the unfavorable columnar crystal structure (Jackson et al: Journal of Institute of Metals 98, p. 198 [1970]); Gooszenz and Nosch: Zeitschrift fur Metallkunde 64, p. 82 [1973]).

The deteriorating effect of sulphur contamination on hot malleability is eliminated in industrial practice in the case of copper-nickel alloys by the addition of Mn and Mg, and in the case of nickel silver by adding Mn.

Up to the present no uniform method has been known in industrial practice for the treatment of pure copper and copper alloys which would prevent the detrimental action of the unfavorable crystal structure and of the contaminations and thus would result in a favorable crystal structure, enabling an increase in cold malleability to a great extent and rendering possible an intensive cold shaping (up to 70 to 99%).

The invention aims, by the elimination of the drawbacks of the processes known so far, at ensuring a uniform process for the production of bands and sheets of improved malleability, suitable for intensive (70 to 99%) cold shaping, of a controlled crystal structure and improved quality both from pure copper and from copper-bearing materials returned for melting but containing contaminations which are detrimental for the processing plant, by the use of equipment applied for the melting and horizontal continuous casting of copper and copper alloys.

The invention is based upon the recognition that the above object is attainable by adding zirconium boride ($ZrB_2$) to melted copper or copper alloys.

A further basis of the invention is the recognition that at most one-half the amount of zirconium in $ZrB_2$ can be replaced by one or more of the elements Ti, Nb, V, Ca, Mg and Co, without any losses in the favorable properties of the product.

Lastly, the invention is also based upon the recognition that it is possible to eliminate the detrimental effect of lead contamination present in copper or copper alloys by the addition of zirconium.

The addition of $ZrB_2$ results both in the case of pure copper and of copper alloys in an increased cold malleability of products manufactured by horizontal continuous band casting, i.e. the application of any other additives becomes superfluous. Zirconium boride retains its favorable effects also on repeated remeltings. When a band roll produced from copper or copper alloy containing such an additive is subjected, after an intensive cold rolling, to a tempering heat treatment, the formation of a texture causing the detrimental anisotropy of the mechanical properties cannot be detected. This result is surprising because, due to the effect of the regulated crystallization and the applied intensive cold shaping and heat treatment, an unfavorable texture formation could be expected.

Accordingly, the invention relates to the production of bands or sheets of isotropic mechanical properties and subjectable to an intensive (70 to 99%) cold shaping from copper or copper alloys. According to the invention one proceeds by adjusting the $ZrB_2$ content of the melted metal bath by the addition of $ZrB_2$ to a level between 0.01% by weight and 0.075% by weight, replacing, if desired, not more than 50% by weight of the zirconium content of the added $ZrB_2$ (up to 0.0375% by weight) by one or more of the metals Ti, V, Nb, Ca, Mg and Co, and, if desired, adding zirconium to the metal bath in a stoichiometric ratio calculated for the Pb content of the alloy when such Pb exceeds 0.015% by weight, then solidifying the metal bath containing the additives in the form of a band, and maintaining, if desired, an inert gas atmosphere in the heat-stabilizing furnace of the casting equipment and/or applying an inert gas lock and secondary cooling when solidifying the metal bath.

According to a preferred embodiment of the process according to the invention, the metal bath is solidified at a linear rate of 1.5 to 7.5 mm/sec and upon the solidification of the metal bath secondary cooling is carried out by means of an inert gas and/or water.

According to the invention one proceeds expediently so that a $ZrB_2$ content of about 0.020 to 0.075% by weight is maintained in the heat-stabilizing furnace of the continuous casting equipment, by adding not more than 5% by weight of $ZrB_2$-containing copper or copper alloys, also taking into account the microalloying element contents of the wastes recycled for repeated melting. Not more than half of the zirconium content of $ZrB_2$ can be replaced by the metals Ti, V, Nb, Ca, Mg or Co. On eliminating the effect of lead contamination, stoichiometric amounts of zirconium are added for the lead content over 0.015% by weight.

In order to increase the efficiency of the process, preferably a protective atmosphere of an inert gas and secondary cooling are applied in the heat-stabilizing furnace by blowing such atmosphere onto the band leaving the crystallizing graphite cup. The band roll crystallized under controlled conditions at a linear speed of 1.5 to 7.5 mm/sec (in case of alloys containing a $\gamma$-$\delta$-phase, after an adequate homogenization) is then subjected to an intensive cold rolling to an extent of 70 to 99%, depending on the nature of the alloy, upon the dimensions and properties (soft, specially ring-hard, etc.) of the finished band.

The main advantages of the process according to the invention are as follows:

(a) It can be carried out in a simple way on an industrial scale.

(b) It makes possible the economical production of bands and sheets from both pure copper and copper alloys ($\alpha$—Sr, $\alpha+\beta$—Sr, AlP, CuNi bronzes including also Al, Be, Sn and Cr bronzes), a marked saving in material and power, and an optimum efficiency of the rolling mill equipment.

(c) It renders possible the safe and economic processing of the usually strongly contaminated wastes recycled from the manufacturing plant or from the cycle of the manufacturing plant.

(d) It makes possible the improvement of the quality of bands and sheets produced in rolling mills and the maintaining of homogeneous, isotropic mechanical properties.

(e) It results in the saving of certain heat-treatment and pickling operations.

The process according to the invention is further illustrated by the aid of the below-given Examples.

EXAMPLE 1

For the production of a soft copper band of a thickness of 0.1 mm, a copper cathode is melted in the conventional manner in a channel-type induction furnace. During the melting period the bath is covered with dry charcoal. When the temperature of the metal bath reaches 1200° C., it is tapped into the heat-stabilizing furnace of a continuous band-casting machine. When the tapping is ended, 0.03% by weight (referred to the weight of metal) of $ZrB_2$ is added as a 5% Cu-$ZrB_2$ alloy, then the casting is started. A band of 15 mm thickness and 250 mm width is allowed to crystallize at a drawing speed of 12 m/hour, and meanwhile a nitrogen gas lock and secondary cooling are continuously applied. The consumed liquid metal is replaced at a definite rate, and meanwhile the freshly introduced metal is complemented at each feeding by an amount of $ZrB_2$ corresponding to 0.03% by weight of the amount of freshly added metal. On removing a superficial 0.5 mm thick layer from both sides of the cast band, it is wound into rolls of, for example, 2 tons weight. These rolls are defatted and then rolled on a duo-roll mill stand to 2 mm thickness in 7 steps, then rolling is continued on a so-called quarto mill stand to produce a band of 0.2 mm thickness. Subsequently the band is tempered in a draw-through type heat-treating furnace maintained at a temperature range of 550° to 600° C. and then pickled. The capability of deep-drawing of the band obtained in this way is at least 9.6 Erichsen value.

EXAMPLE 2

One proceeds in the way as specified in Example 1, but 50% of the zirconium present in $ZrB_2$ is replaced by an identical amount of titanium applied as $TiB_2$, i.e. by adding 1.8 kg of Cu-$ZrB_2$ alloy and 1.8 kg of Cu-$TiB_2$ alloy. The capability of deep-drawing of the band produced in this way is the same as that of the band according to Example 1.

EXAMPLE 3

On producing a deep-drawable brass band of 0.5 mm thickness of a tissue structure of $\alpha+\beta$ (composition: Cu 63, Zn, i.e. containing 63.0% by weight of Cu, 36.6% by weight of Zn and 0.4% by weight of Ni), recycled waste corresponding to 60% of the applied charge is melted in a channel-type induction furnace, then a copper cathode corresponding to 25% of the charge, 75:25% Cu-Ni chips of an amount corresponding to 0.4% Ni and a tin block of an amount corresponding to the composition of the alloy, are added.

On determining the amount of Cu-Ni chips, the nickel content of the previously melted wastes is taken into account. When the temperature of the bath attains the tapping temperature, the bath is tapped into the heat-stabilizing furnace of the continuous band-casting machine. Prior to tapping, 6 kg. of 5% Cu-$ZrB_2$ alloy (corresponding to 0.05% by weight of the tapped metal alloy of 600 kg weight) are added to the melt which is subsequently crystallized into a band of 15 mm thickness and 320 mm width at a drawing speed of 10 mm/hour. On removing a superficial 0.5 mm thick layer from both sides of the cast band, the band is wound to form rolls of 2 tons weight each. These rolls are then rolled, after defatting, on a duo-roll mill stand in 13 steps to a thickness of 1.8 mm, then rolling is continued on a so-called quarto mill stand to produce a band of 0.5 mm width. The band is tempered in a continuously operated heat-stabilizing furnace at 550° C. and then pickled. The tensile strength of the band obtained in this way is 30–38 kp/mm$^2$, its elongation $\delta_{10}$ is at least 44% and its capability of deep-drawing is at least 11.8 Erichsen value.

EXAMPLE 4

On melting a charge contaminated with lead one proceeds in the way as specified in Example 3, with the difference that besides the addition of $ZrB_2$, also 0.025% by weight of Zr are added as 1.5 kg of a 10% Cu-Zr alloy in order to eliminate the effects of 0.05% Pb present as contamination. Subsequently one proceeds as described in Example 3. The mechanical properties of the band produced in this way are identical with those given in Example 3.

EXAMPLE 5

On producing a spring band of nickel silver (of a composition of CuNi18Zn24, i.e. 18% by weight of Ni, 24% by weight of Zn and 58% by weight of Cu) a copper cathode is melted in a medium-frequency induction furnace, then nickel cathode is added in an amount required by the desired product composition. Subsequently an amount of recycled nickel silver waste corresponding to 50% by weight of the total charge is introduced into the bath, then, immediately prior to tapping, an adequate amount of zinc required by the desired product composition is added.

The melt is then transferred into the heat-stabilizing furnace of the continuously operated band-casting equipment. Into this furnace an amount corresponding to 0.04% by weight of the melt, i.e. in case of 600 kg of melt 2.4 kg of a 5% Cu-$ZrB_2$ alloy is introduced, also taking into account the useful microalloying component content of the recycled waste amounting to 50% by weight of the charge. On starting the casting procedure, a band of 15 mm thickness and 320 mm width is allowed to crystallize at a drawing speed of 11 m/hour. On removing a 0.5 mm thick superficial layer by milling from both sides of the cast band, the band is rolled on a duo roll stand in 14 steps to 2 mm thickness, then on a quarto roll stand to 0.74 mm thickness, and tempered in a protecting gas atmosphere in a heat-stabilizing furnace. The tempered band is rolled on a quarto roll stand to 0.5 mm thickness. The Vickers hadrness of the band obtained in this way is in the range of HV 190 to 230.

EXAMPLE 6

Once proceeds in the way specified in Example 5, with the difference that 50% by weight of zirconium are replaced by Nb, i.e. 1.2 kg of a 5% cu-$ZrB_2$ alloy and 1.2 kg of a 5% Cu-$NbB_2$ alloy are added to a charge of 600 kg. The hardness of the band obtained in this way is the same as that given in Example 5.

EXAMPLE 7

On producing a spring-hard tin bronze band (SnBz6 ["Bz" meaning -bronze-]), i.e. of a nominal Sn content of 6% by weight, of a thickness of 0.5 mm, a copper cathode is melted in a channel-type induction furnace. During the melting the surface of the bath is covered with dry charcoal. Prior to the addition of tin, an amount of Cu-P alloy corresponding to 0.02% by weight of P is added, then the melt is tapped by means of a kettle into the heat-stabilizer furnace of the continuously operated band-casting machine. Subsequently, 6 kg of a 5% Cu-$ZrB_2$ alloy (corresponding to 0.05% by weight of the tapped amount of 600 kg metal alloy) are added to the melt, then casting is started and a band of 15 mm thickness and 320 mm width is allowed to crystallize at a drawing rate of 14 m/hour. On removing a superficial 0.5 mm thick layer by milling from both sides of the band, and subsequent defatting, an alloy having a tin content over 6% is rolled after a homogenizing heat treatment (at 650° C. for 1.5 hours), and an alloy having a tin content below 6% is rolled without such homogenizing heat treatment to a thickness of 2 mm in 11 steps, then to 1.05 mm thickness in a quarto rolling stand. Finally the band is tempered in a pull-through type tempering furnace and rolled to a thickness of 0.5 mm. The Vickers hardness of the band obtained in this way is between HV 180 and 220.

EXAMPLE 8

One proceeds according to Example 7, with the difference that 25% by weight of $ZrB_2$ are replaced by V, i.e. 4.5 kg of a 5% Cu-$ZrB_2$ alloy and 1.5 kg of a 1%

$Cu\text{-}VB_2$ alloy are added to a charge of 600 kg. The hardness of the band obtained in this way is identical with the value given in Example 7.

EXAMPLE 9

On producing a 0.5 mm thick tempered hard Be bronze band, a copper cathode is melted in a medium frequency induction furnace. During melting, the surface of the bath is covered with dry charcoal. The Be content of the alloy is adjusted to the desired value, by the addition of a Cu-Be pre-alloy, then the melt is tapped into the medium-frequency heat-stabilizer furnace of the continuously operated band-casting machine where a nitrogen or argon gas atmosphere is maintained over the metal bath. Subsequently 6 kg of a 5% $ZrB_2$ alloy, i.e. 0.05% by weight of the 600 kg tapped metal alloy, are added to the melt, casting is started, and a band of 15 mm thickness and 250 mm width is allowed to crystallize at a drawing rate of 12 m/hour. During the casting period the band, after leaving the chill form, is cooled in a nitrogen lock. After removing a superficial 0.5 mm thick layer by milling from both sides of the band, the band is defatted and rolled on a duo rolling stand to 2 mm thickness, then on a quarto rolling stand to 0.5 mm thickness, meanwhile tempering the band, when it attains a thickness of 1 mm and, respectively, 0.75 mm in a pull-through type heat-treating tempering furnace. The band obtained in this way has a Vickers hardness of at least HV 215.

EXAMPLE 10

For producing a 0.5 mm thick tempered Al bronze band, i.e. an aluminum bronze band containing 5% by weight of aluminum, copper cathode is melted in a medium-frequency induction furnace, then according to the desired composition a 30% AlCu pre-alloy is given to the melt. Subsequently the melt is tapped into the heat-stabilizing furnace of the continuously operated band-casting equipment. Then 4.8 g of a 5% $Cu\text{-}ZrB_2$ alloy (corresponding to 0.04% by weight of 600 kg of total melt) are added to the medium-frequency heat-stabilizing furnace, casting is started and a band of 15 mm thickness and 32 mm width is allowed to crystallize at a drawing rate of 11 m/hour. On removing a superficial 0.5 mm thick layer from both sides of the band by milling, the band is defatted and rolled on a duo rolling stand to 2 mm thickness, then on a quarto rolling stand to a thickness of 0.8 mm, and then tempered in a heat-treatment furnace under a protecting gas atmosphere. The tempered band is rolled to 0.5 mm thickness on a quarto rolling stand. The band obtained in this way has a tensile strength of $\sigma B = 45$ kp/mm$^2$, and an elongation $\sigma_5$ = at least 20%.

EXAMPLE 11

On producing a 0.8 mm thick soft Cu-Ni25 band, i.e. a band containing 25% by weight of Ni and 75% by weight of Cu, a copper cathode and recycled Cu-Ni waste are melted in a medium-frequency induction furnace. Prior to feeding the nickel, alloying with 0.3% by weight of Mn is carried out by means of a 33% Cu-Mn pre-alloy. After the melting of the nickel, deoxidation is carried out with 0.01% by weight of carbon. When the whole charge is melted, it is heated to the tapping temperature and prior to tapping, deoxidation is carried out with 0.05% by weight of Mg, using a graphite disk. When the tapping temperature is reached, the melt is tapped with the use of a kettle into the heat-stabilizing furnace of the continuously operated casting machine where 0.025% by weight of $ZrB_2$ (i.e. 3 kg of a 5% $Cu\text{-}ZrB_2$ alloy) are added to 600 kg of melt. On starting the casting procedure, a band of 15 mm thickness and 250 mm width is allowed to crystallize at a drawing rate of 10 m/hour, and meanwhile a nitrogen gas lock and secondary cooling are applied. The cast band is rolled on a duo rolling stand in 11 steps to 2 mm thickness, then on a quarto rolling stand to 0.8 mm thickness, and tempered in a pull-through furnace under a protecting gas atmosphere. The tensile strength of the band obtained in this way is $\sigma_B = 30\text{–}38$ kp/mm$^2$ and its elongation $\sigma_5$ is at least 40%.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims

What is claimed is:

1. Process for the production of bands or sheets of isotropic mechanical properties from a melted bath of copper or copper alloys containing from 0% to a small amount of lead, said bands or sheets being subjectable to an intensive cold shaping, comprising adding to the melted bath $ZrB_2$ in an amount of between 0.01% and 0.075% by weight, and replacing not more than 50% by weight of the zirconium content of the added $ZrB_2$ by at least one of the groups of metals consisting of Ti, V, Nb, Ca, Mg, and Co, then solidifying the metal bath containing the additives in the form of a band.

2. A process as claimed in claim 1, wherein the metal bath is solidified at a linear rate of 1.5 to 7.5 mm/sec, and comprising cooling the bath while solidifying it.

* * * * *